US007287776B2

(12) United States Patent
Papon

(10) Patent No.: US 7,287,776 B2
(45) Date of Patent: Oct. 30, 2007

(54) SNOWBOARD BINDING

(75) Inventor: Christophe Papon, Montferrat (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 10/911,259

(22) Filed: Aug. 4, 2004

(65) Prior Publication Data

US 2005/0040624 A1 Feb. 24, 2005

(30) Foreign Application Priority Data

Aug. 21, 2003 (FR) ..... 03 50443

(51) Int. Cl.
*A63C 9/00* (2006.01)

(52) U.S. Cl. ..... 280/636; 280/633; 280/620; 280/623; 280/14.22; 280/616; 280/617

(58) Field of Classification Search ..... 280/636, 280/633, 620, 623, 14.22, 616, 617
See application file for complete search history.

(56) References Cited

U.S. PATENT DOCUMENTS 2,626,189 A * 1/1953 Brown ..... 52/638
3,797,844 A * 3/1974 Smolka et al. ..... 280/617
3,950,001 A * 4/1976 Weigl ..... 280/618
4,185,852 A * 1/1980 Himmetsberger et al. .. 280/618
4,955,633 A * 9/1990 Stritzl et al. ..... 280/633
5,344,179 A * 9/1994 Fritschi et al. ..... 280/618
5,397,149 A * 3/1995 Couderc et al. ..... 280/602
6,315,305 B1 * 11/2001 Gien ..... 280/14.24
6,328,328 B1 12/2001 Finiel
6,513,826 B1 * 2/2003 Hangl ..... 280/602
6,886,849 B2 * 5/2005 Mandon ..... 280/618

FOREIGN PATENT DOCUMENTS

DE 100 21 203 A1 11/2001
EP 1 226 849 A2 7/2002
EP 1 240 925 A1 9/2002

* cited by examiner

*Primary Examiner*—Christopher P. Ellis
*Assistant Examiner*—Cynthia F. Collado
(74) *Attorney, Agent, or Firm*—Burr & Brown

(57) ABSTRACT

A snowboard binding (1) including a base plate (2), arranged to receive the sole of the user's boot, and an element (5) for securing to the board located in the central part of the base plate, wherein the base plate (2) includes two plates (10, 11) for receiving the contact of the boot sole, these two plates (10, 11) partially overlapping and each having an adjustable longitudinal position, and wherein locking means (25) pass through the two plates (10, 11) in their overlap zones (14, 16) in order to anchor them in an element (5) for securing the base plate to the board.

8 Claims, 1 Drawing Sheet

SNOWBOARD BINDING

This application claims the benefit of French Application 03.50443, filed Aug. 21, 2003, the entirety of which is incorporated herein by reference.

TECHNICAL FIELD

The invention relates to the field of sports involving gliding over snow and, more precisely, that of snowboarding. It relates more specifically to a novel snowboard binding structure that has advantageous capabilities in terms of adjustment of the configuration of the contact surface between the user's boot and the binding base plate.

PRIOR ART

Generally speaking, snowboard bindings for receiving "soft" boots have a base plate that is secured to the board and to which the other binding members, such as the highback or the gripping straps, are connected.

In order to allow adjustment and orientation of the binding relative to the board, the base plate is frequently mounted on the board via an adjustment disk located in the central part of the base plate and allowing a plurality of pivot positions of the base plate relative to the board. Owing to the relative mechanical complexity of this adjustment disk, there is felt to be a need to protect the disk against the ingress of snow and also possible impacts resulting from the operations involved in fitting the boot into the binding.

Furthermore, the boots used with this type of binding generally have a sole with a curved lower surface to facilitate the walking movement when the boot is released from the binding in order to compensate for the curvature of the front and/or rear ends of the boot and thus to fill in the space separating them from the base plate. It is thus known to provide the binding with elements known as "gas pedals", which form reasonably inclined ramps located at the front and rear end of the board.

By virtue of these gas pedals, the bearing forces exerted by the user are efficiently transmitted, despite the fact that the boot does not have a flat sole. There is also felt to be a need to adapt the position of the gas pedal as a function of the boot configuration and, in particular, of the boot size.

Currently, the elements forming the gas pedals can be adjusted relative to the base plate using screwing (or equivalent) mechanisms inside longitudinal apertures. If the binding includes two adjustable elements, at the front and at the rear, it will be understood that the independent adjustments of each of the elements may give rise to poor positioning of the boot relative to the binding.

The invention aims to solve the various problems referred to above.

SUMMARY OF THE INVENTION

The invention thus relates to a snowboard binding that includes a base plate, arranged to receive the sole of the user's boot and an element for securing to the board, of the adjustment-disk type, located in the central part of the base plate.

In accordance with the invention, this binding is defined in that the base plate includes two plates for receiving the contact of the boot sole, these two plates each having an adjustable longitudinal position and partially overlapping in their overlap zone. The binding also includes locking means passing through the two plates in order concomitantly to anchor the two plates in the element for securing to the board.

In other words, the invention aims to make the position of the two parts that form the upper surface of the base plate adjustable such that single, joint immobilization allows their position to be locked, thus limiting the number of operations carried out when adjusting the binding.

In this way, the overlap of the two plates complementarily provides protection for the adjustment disk against risks of external blows.

Advantageously, in practice, each of these plates may have an end that is raised in order to act as a gas pedal. In this way, when the binding includes two raised zones, at the front and at the rear, adjustment may be made while keeping the mid point of the boot substantially constant.

Advantageously, in practice, a fraction of the upper surface of the plates, in particular the raised end thereof, may be covered with a layer of elastomeric material intended, on the one hand, for increasing the co-efficient of friction of the boot relative to the binding and, on the other hand, for providing a degree of vibration absorption owing to its compressibility. A similar effect may be obtained when a fraction of the upper surface of the plates has transverse grooves acting as notches, thus preventing the foot from unexpectedly coming out of the binding during the operation of fitting it into the binding.

Advantageously, in practice, the overlap portions of the two plates may partially interpenetrate in order to provide longitudinal guiding during their respective displacements. In other words, the form of the plates is such that the facing surfaces form slide rails that prevent any displacement of the plates other than in the longitudinal direction.

As a supplement, the lower face of at least one plate may include mechanical means and, for example, studs that interact with complementary members of the base plate in order to provide longitudinal guiding of the displacement of the plate.

In practice, locking may be via a plurality of in-line holes made in the overlap parts of the plates.

BRIEF DESCRIPTION OF THE FIGURES

The way in which the invention is implemented and also the advantages arising therefrom will become clearly apparent from the description of the following embodiments, which support the appended figures, in which.

IMPLEMENTATION OF THE INVENTION

Figure 1:
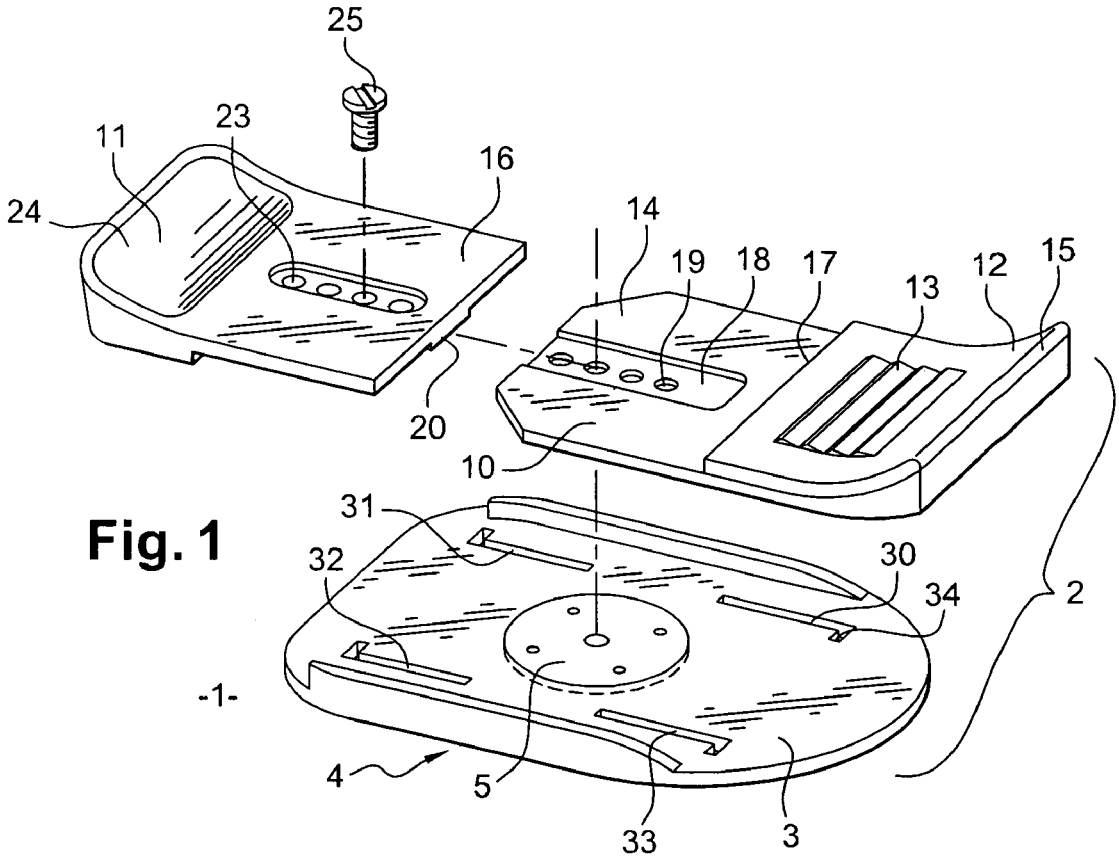
FIG. 1 is a summarized, exploded perspective view of the base plate of a binding produced in accordance with the invention, shown in part.
Figure 2:
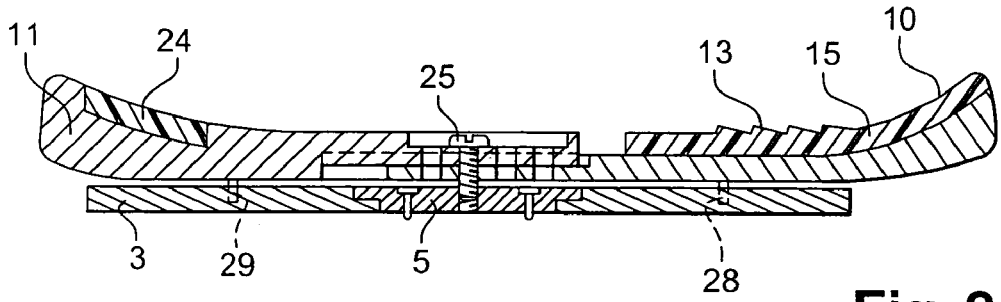
FIG. 2 is a longitudinal sectional view of the binding of FIG. 1.
Figure 3:
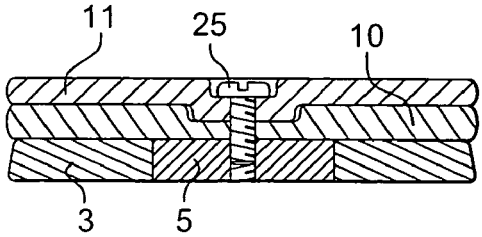
FIG. 3 is a transverse sectional view of the same binding.

The binding (1), illustrated in FIG. 1, is shown only partially, emphasis being placed on the principal aspects of the invention, i.e. the elements of the binding base plate. The base plate (2) is thus composed of a bottom part (3) for coining into contact with the upper face of the board. The lower face (4) is the lower surface of the base plate (2) and is thus substantially planar.

In the embodiment illustrated, the bottom part (3) of the base plate (2) includes a central recess for receiving a mounting disk (5), illustrated diagrammatically as secured to the board and arranged to allow the pivoting of the base plate (2).

The upper part of the binding, i.e. the heel loop supporting the highback and also the various gripping straps have not been shown.

In accordance with the invention, the upper part of the base plate (2) includes two plates (10, 11) that form the upper face of the base plate (2) on which the lower face of the user's sole rests.

More precisely, and as illustrated in FIG. 1, the front plate (10) includes a front end (12) that is raised so as to receive the bearing forces of the boot's front end. This front end (12) may include an additional upper layer (15) made from an elastomeric material. It includes a number of notches (13) produced transversely and that may adopt multiple forms, for example adapted to the footprints of specific boots. These notches (13) are oriented so as to limit the risk of seeing the boot displaced forward when it is being fitted into the binding.

In its rear end (14) the front plate (10) has a smaller thickness, which enables it to receive the front end (16) of the rear plate (11) without giving rise to excess thickness. A height difference (17) thus separates the front (12) and rear (14) ends of the front plate (10).

In the central part, the rear end (14) of the front plate (10) includes a groove (18) oriented substantially longitudinally. This groove (18) is provided with a plurality of through-holes (19). This groove (18) is intended for receiving a protuberance (20) formed under the lower face of the front part (16) of the rear plate (11). This protuberance (20) has dimensions that are substantially identical to those of the groove (18) in order to ensure interpenetration of the two plates (10, 11) and their longitudinal guiding.

Notches (not shown) may also be provided on the rear plate (11), in its front end (16) and/or in the raised zone. A zone of elastomeric material (24) may be arranged in this raised zone, in a housing provided for that purpose.

A plurality of holes (23) is also provided in the median zone of the rear plate (11), with the same spacing as the holes (19) in the front plate (10). A locking element, illustrated in FIG. 1 by a screw (25), is able to pass through the holes (23, 19) of the two plates (10, 11) and comes to be housed in the pivot-adjustment disk (5).

Of course, the invention is in no way limited to the embodiment illustrated in the figures, but covers multiple variants in terms of the geometry of the characteristic plates.

Complementarily, longitudinal adjustment of the plates (10, 11) may be provided by the sliding of elements (28, 29) that form catches, using curved studs under the lower face of each of the plates (10, 11). These catches may slide in slots (30-33) made in the upper face of the bottom part (3) of the base plate (2). These slots (30-33) may have an end (34) that is offset in order to allow the insertion of the studs during initial mounting of the binding.

It goes without saying tat the forms of the plates (10, 11) may be different from those illustrated in a simplified manner with the aim of facilitating understanding of how the invention functions. Thus, the front (10) and/or rear (11) plates may include mutual overlap zones.

It is clear from the aforesaid that the binding in accordance with the invention has multiple advantages and, in particular, that of allowing simultaneous, concomitant adjustment of the two plates that form the upper face of the base plate. Furthermore, as the two plates overlap in the central part of the binding, they protect the locating disk by covering it over.

The invention claimed is:

1. A snowboard binding comprising a base plate, arranged to receive the sole of the user's boot, and an element for securing the base plate to the snowboard located in the central part of the base plate, the base plate comprising:

first and second plates for receiving the contact of the boot sole, the first plate extending over and covering a portion of the second plate such that the portion of the second plate is located between a portion of the first plate and the snowboard, and each plate having an adjustable longitudinal position; and locking means passing through the two plates in a zone where the first plate extends over and covers the portion of the second plate in order to anchor the two plates in the element for securing the base plate to the snowboard.

2. The snowboard binding as claimed in claim 1, wherein the end of at least one of the plates is raised.

3. The snowboard binding as claimed in claim 1, wherein a fraction of the upper surface of the plates is covered with a layer of elastomeric material.

4. The snowboard binding as claimed in claim 1, wherein a fraction of the upper surface of the plates has transverse grooves.

5. The snowboard binding as claimed in claim 1, wherein the two plates partially interpenetrate in the zone where the first plate extends over and covers the portion of the second plate in order to provide longitudinal guiding during their respective displacements.

6. The snowboard binding as claimed in claim 1, wherein the lower face of at least one plate includes studs that interact with complementary members of the base plate in order to provide longitudinal guiding of the displacement of the plate.

7. The snowboard binding as claimed in claim 1, wherein the first and second plates include a plurality of in-line holes in the zone.

8. The snowboard binding as claimed in claim 2, wherein the raised end of at least one of the plates is covered with a layer of elastomeric material.

* * * * *